United States Patent [19]

Romer et al.

[11] Patent Number: 4,486,153

[45] Date of Patent: Dec. 4, 1984

[54] REFRIGERATOR WITH ENCAPSULATED MOTOR COMPRESSOR

[75] Inventors: Bendt W. Romer, Sonderborg; Jens O. Lorentzen, Augustenborg, both of Denmark

[73] Assignee: Danfoss A/S, Nordborg, Denmark

[21] Appl. No.: 478,337

[22] Filed: Mar. 24, 1983

[30] Foreign Application Priority Data

Apr. 10, 1982 [DE] Fed. Rep. of Germany ..... 3213476

[51] Int. Cl.[3] ..... F04B 39/12

[52] U.S. Cl. ..... 417/313; 55/23; 55/437; 62/296; 417/312

[58] Field of Search ..... 62/296, 512; 417/902, 417/312, 313; 55/23, 437, DIG. 17

[56] References Cited

U.S. PATENT DOCUMENTS

| | | | |
|---|---|---|---|
| 2,277,999 | 3/1942 | Thompson | 62/512 X |
| 3,483,677 | 12/1969 | Pinto | 55/DIG. 17 |
| 3,494,110 | 2/1970 | Reed et al. | 55/437 X |
| 4,086,032 | 4/1978 | Nishioka et al. | 417/902 X |
| 4,147,479 | 4/1979 | Morse | 417/902 X |
| 4,370,104 | 1/1983 | Nelson et al. | 62/296 X |
| 4,371,319 | 2/1983 | Murayama et al. | 417/902 X |

*Primary Examiner*—William E. Tapolcai
*Attorney, Agent, or Firm*—Wayne B. Easton

[57] ABSTRACT

A refrigeration compressor is provided with a combined sound dampening and centrifugal liquid separator chamber.

9 Claims, 4 Drawing Figures

REFRIGERATOR WITH ENCAPSULATED MOTOR COMPRESSOR

The invention relates to a refrigerator with encapsulated motor compressor, comprising a suction sound damper and liquid separator which are disposed in the capsule, a suction gas flow led direct from the suction connector passing through the capsule wall to the suction sound damper, and a capsule interior under suction pressure.

In a known refrigerator of this kind (GB-OS No. 2,066,374), the suction connector terminates at the capsule wall at a spacing from the inlet orifice of a bent tube. The latter extends predominantly in the interior of a sound damping chamber and its horizontal start and its vertical end pass through the sound damper wall. In its horizontal first section, the tube has an orifice by which it communicates with the interior of the sound damper. In this arrangement, suction gas flowing through the suction connector is to a considerable extent led directly into the bent tube where the gaseous components pass through the orifice directly into the sound damping chamber but, because of their inertia, liquid particles remain in the tube, are separated at the bend in the tube and then drip off into the oil sump. In this arrangement, the space of the sound damping chamber is reduced by building the oil separator into the bent tube and this detrimentally influences sound damping in many cases. In addition, practically all the liquid particles carried along by the suction gas are separated.

It is also known (DE-PS No. 26,50,935), to provide a liquid separator in the form of a centrifugal liquid separator having a rotationally symmetrical separator face with a vertical axis, a tangential inlet passage at the top, a central outlet connector at the top and a central outlet aperture at the bottom. This centrifugal liquid separator is disposed in the suction conduit outside the capsule. Beneath the outlet aperture there is a collecting chamber which communicates with the capsule interior through an additional conduit.

The invention is based on the problem of providing a refrigerator of the aforementioned kind wherein the space required for the liquid separator does not influence the space required for the sound damper.

This problem is solved according to the invention in that a chamber of the suction sound damper is in the form of a centrifugal liquid separator having a rotationally symmetrical separator face with a vertical axis, a tangential inlet passage at the top, a central outlet connector at the top and a central aperture at the bottom.

In this construction, the interior of the liquid separator also serves as a sound damping chamber. No space is therefore required in addition to that for adequate sound damping. In so far that the liquid separator has to be made smaller than is necessary for complete liquid separation for reasons of sound damping or because of the limited space in the interior of the capsule, this is unimportant because it has proved advantageous for a residue of liquid to remain in the suction gas stream. The oil improves the lubrication of the compressor piston. Small amounts of liquid refrigerant evaporate up to reaching the compressor, reduce the temperature of the refrigerant, increase the degree of filling of the compressor and thereby increase the efficiency.

Advantageously, the centrifugal liquid separator forms the first chamber of a suction sound damper having at least one further chamber. This ensures that the sound damper chambers are not filled with liquid and the evaporation of residual particles of liquid refrigerant can take place in the further chamber.

In a preferred embodiment, to form the liquid separator, there is a housing bore which is closed by a cover at the top, contains an insert above the inlet passage that has the outlet connector, and is provided with an outlet passage extending from between the cover and insert. This results in a particularly simple construction and an end product of high stability and strength.

It is also favourable if, to form a second sound damping chamber, there is a housing depression which is closed by a cover and into which the outlet passage opens near the cover. In this way one obtains two sound damping chambers behind each other in a single housing component.

Preferably, the housing is made in one piece with the compressor housing. In that case, the conduit leading from the last sound damping chamber can likewise be a bore in the housing.

The outlet aperture is desirably a throttle opening. This avoids the orifice being a marked suction gas bypass for normal operation.

It is recommended that a passage connecting the last chamber of the suction sound damper to the suction side of the cylinder head be connected to the interior of the capsule by way of a throttle passage. This is certain to keep the pressure in the capsule so low that separated liquid runs off at the separator.

In the case of a motor compressor which is resilient in the capsule and to which the suction sound damper and the liquid separator are rigidly connected, in order to permit the direct connection between the suction connector and the inlet passage, the inlet passage may be formed by a spring-loaded tube which is passed through the separator wall and presses a hinged tube against the suction connector, the hinges being formed at both ends each by a cylindrical end and a diverging mouth of the adjoining portion. The spring-loaded tube tends to compensate for differences in spacing and the hinged tube for differences in angle between the suction connector and the inlet passage.

A different possibility is for a spring-loaded telescopic tube to be disposed between the suction connector and inlet passage and also forming a hinged tube, the hinges being formed at both ends each by a cylindrical end and a diverging mouth of the adjoining portion.

Another possibility is for the inlet passage to comprise an inlet funnel and for the suction connector to comprise an outlet nozzle associated with the funnel without contact.

Preferred examples of the invention will now be described with reference to the drawing, wherein.

Figure 1:
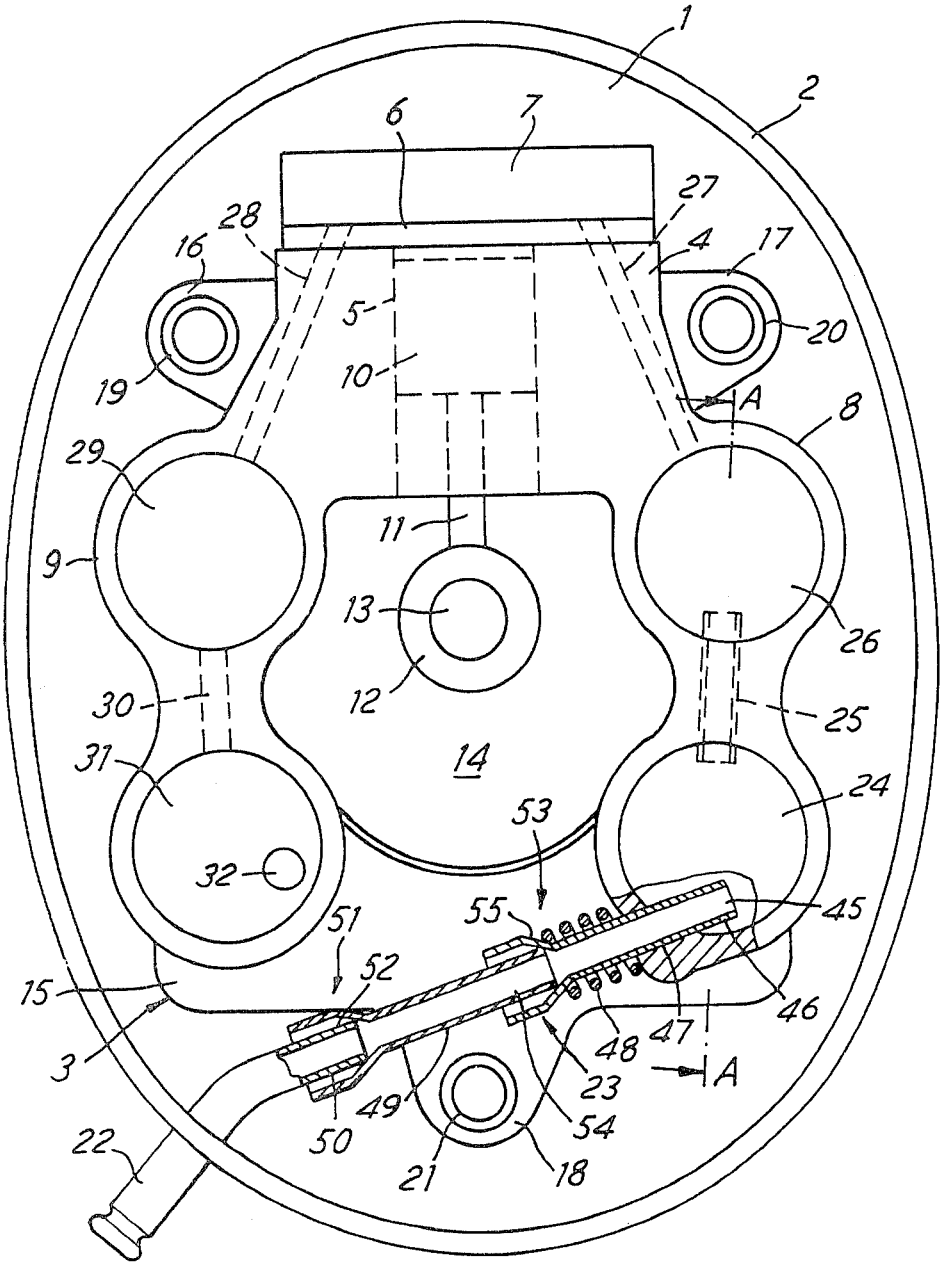
FIG. 1 is a diagrammatic plan view of an encapsulated motor compressor with the cover of the capsule removed.

FIG. 1 shows that a motor compressor 3 is arranged in the interior 1 of a capsule 2. A compressor housing 4 having a cylinder 5 and a valve plate 6 at the end and carrying a cylinder head 7 comprising pressure and suction valve chambers comprises a lateral suction sound damper extension 8 and a pressure sound damper extension 9 on the other side. The piston 10 disposed in cylinder 5 is connected by way of a connecting rod 11 and a big end 12 to the crank 13 of a crank shaft driven by the rotor 14 of an electric motor which also has a stator 15. This motor compressor 3 has extensions 16, 17 and 18 engaged by helical springs 19, 20, 21 secured in a manner not shown to the capsule 2.

In operation, suction gas is supplied by way of a suction connector 22 passing through the wall 2 of the capsule and a movable connection 23, a first sound damping chamber 24, a passage 25 forming a throttling point, a second sound damping chamber 26 and a passage 27 to the suction side of the cylinder head 7. Compressed gas is led away to the outside by way of the pressure side of the cylinder head, a passage 28, a first compression sound damping chamber 29, a throttle point 30, a second compression sound damping chamber 31 and a pressure conduit 32.

Figure 2:
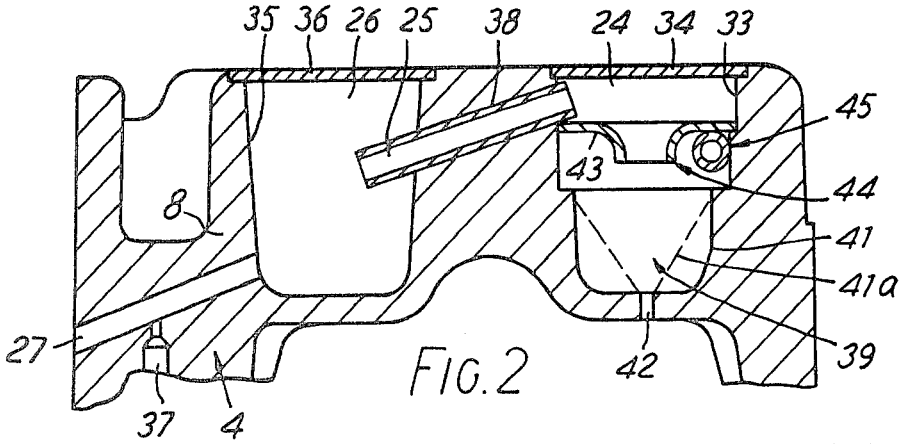
FIG. 2 is a section on the line A—A in FIG. 1.

The construction of the suction sound damper extension 8 is shown in FIG. 2. In the housing 4 there is a first bore 33 which is closed at the top by a cover 34 and a second depression 35 closed at the top by a cover 36. The drill passage 27 communicates with the interior 1 of the capsule by way of a throttle passage 37. An oblique bore 38 produced before inserting the cover receives a tube forming the passage 25. The sound damping chamber 24 formed by the bore 33 at the same time serves as a centrifugal liquid separator 39. For this purpose, there is a rotationally symmetrical separator face 41 and an outlet aperture 42 at the bottom. Further, a sheet metal insert 43 inserted in the bore carries a downwardly directed outlet connector 44. An inlet passage 45 opens tangentially at substantially the level of the connector.

In operation, during the suction stroke suction gas is sucked into the separator 39 by way of the tangential inlet passage. This suction gas thereby receives an eddying motion during which heavy particles such as droplets of liquid move outwardly under the centrifugal effect and then downwardly along the separator face 41 by way of the outlet aperture 42 directly into the interior of the capsule to flow into the oil sump thereof. The cleansed suction gas is led away through the outlet connector 44 to the throttle point 25 and to the second suction sound damping chamber 26. Because the separator is small, a residue of liquid particles remains in the stream of suction gas, which is desirable. The outlet aperture 42 is in the form of a throttle point. It has, for example, a diameter of 1.5 mm. The diameter of the bore 33 can be between 20 and 30 mm.

In the FIG. 1 embodiment, the inlet passage 45 is formed by a tube 46 which is displaceable in a bore 47 of housing 4 and subjected to a spring 48. It pushes a hinged tube 49 against the outlet end 50 of the suction connector 22. A first hinge 51 is formed by this end 50 and a diverging mouth member 52 at the hinged tube 49. A second hinge 53 is formed by the other end 54 of the hinged tube and a diverging mouth member 55 of tube 46. If, therefore, the motor compressor 3 moves during operation and consequently also the extension 8 because of the resilient suspension with respect to the capsule 2, there can be a compensation of the angle by reason of the two hinges and compensation of the spacing by reason of the displaceable tube 46.

Figure 3:
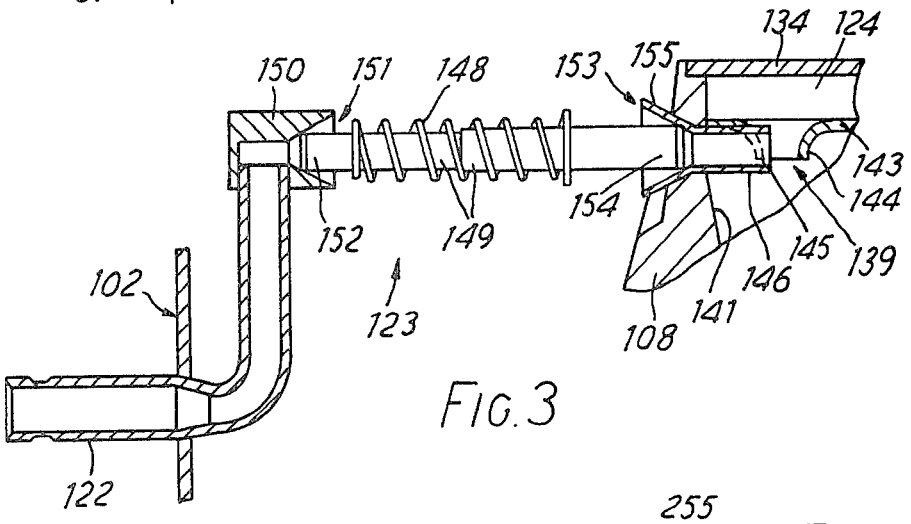
FIG. 3 is a side elevation of an alternative connection between the suction connector and inlet passage.

In the FIG. 3 embodiment, components corresponding to those of FIGS. 1 and 2 are provided with the same reference numerals but increased by 100. In this case, the suction connector 122 is provided with an upwardly directed section which carries a mouth member 150 that is placed thereon and has an enlargement. The tangential inlet passage 145 is formed by a tube 146 which is tightly inserted in the wall and carries a diverging mouth member 155. Two parts of a telescopic tube 149 are pushed apart by a spring 148. The ends 152 and 154 engage in the respective mouth members 150 and 155, thereby again to form two hinges 151 and 153. Here, again, compensation for angle and compensation for spacing are possible upon relative motion between the inlet passage 145 and suction connector 122.

At the aforementioned two positions, there need be no seal in the vicinity of the hinges 51, 53 and 151, 153. This is because the interior 1 of capsule 2 is likewise at suction pressure. All that is important is that the greater proportion of the suction gas reaches the compressor directly from the exterior of the capsule by way of the suction sound damping chambers.

Figure 4:
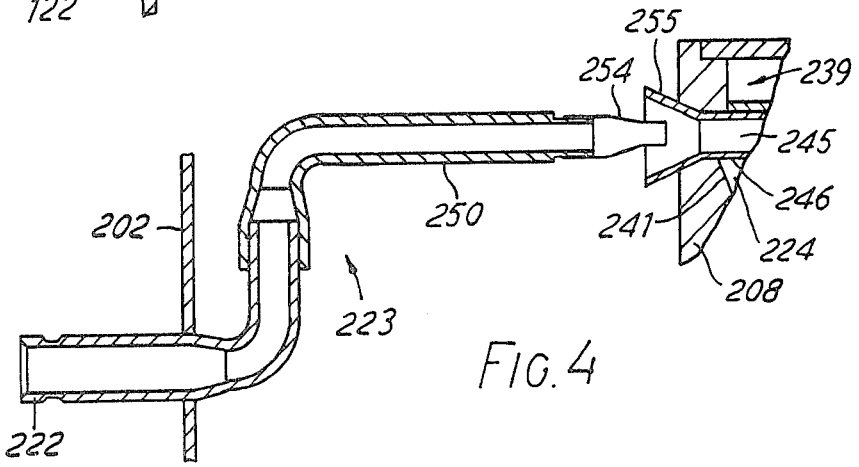
FIG. 4 is another modification of the connection between the suction connector and inlet passage.

FIG. 4 shows a further embodiment in which integers corresponding to those of FIGS. 1 and 2 have the same reference numerals increased by 200. In this case, the tube 246 forming the inlet passage 245 has a funnel 255. The suction connector 222 is provided with an extension 250 carrying a nozzle 254 at the free end. In conjunction with the funnel 255, this nozzle ensures that, even upon relative motion between the stated parts, the predominent part of the supplied suction gas is led into the centrifugal liquid separator 239.

By means of the throttle passage 37 which opens into the passage 27 comparatively closely to the suction valve, the pressure in the interior 1 of capsule 2 is kept comparatively low. There is therefore no danger of the pressure increasing in this space because refrigerant leak between the cylinder and the piston during the compression stroke. This ensures that there is always a sufficiently large pressure drop between the liquid separator 39 and the interior 1 for leading liquid away through the bore 42. The separator face 41 and outlet aperture 42 could also be formed on a block inserted in the bore of the housing. Separate manufacture of the block facilitates particularly accurate production of the separator face and outlet aperture. The rotationally symmetrical separator face 41 could also be in the form of a cone **41*a* as shown in broken lines in FIG. 2**.

We claim:

1. A refrigerator with an encapsulated motor compressor, comprising, a capsule, a compressor unit resiliently mounted in said capsule, a housing casting for said compressor unit, said housing casting defining (and having) a cylinder chamber for receiving a piston and a combined sound damping and centrifugal liquid separator chamber, first suction gas inlet means connected to and extending through said capsule to said combined chamber, second (said) suction gas inlet means connected to said housing casting and having fluid communication with (including a suction gas inlet connection for) said combined chamber, (and a suction gas inlet connector for said capsule,) said first and second suction gas inlet means having fluid communication and being relatively moveable to each other, said combined chamber having a rotationally symmetrical separator face with a vertical axis for operation as a liquid separator, a tangential inlet passage between said second suction gas inlet means (connection) and the top of said separator face, central gas outlet means adjacent the top of said separator face and a central liquid outlet aperture at the bottom of said separator face.

2. A refrigerator according to claim 1 wherein said combined chamber forms the first chamber of a suction sound damper having at least two chambers.

3. A refrigerator according to claim 1 wherein said combined chamber is formed with a bore, a cover for said bore, said central gas outlet means being an insert above said tangential inlet passage.

4. A refrigerator according to claim 1 wherein said liquid outlet aperture is a throttle opening.

5. A refrigerator according to claim 1 wherein said second suction gas inlet means is formed by a spring loaded first tube having a funnel shaped end, a second tube having a funnel shaped end disposed between said first tube and said first gas inlet means and biased against said first gas inlet means, said funnel shaped ends providing a lost motion hinge effect.

6. A refrigerator according to claim 1 wherein said second suction gas inlet means and said first suction gas inlet means each has a funnel shaped end, and spring loaded telescopic tube means extending between said first and second means, said funnel shaped ends and said telescopic tube means providing a lost motion hinge effect.

7. A refrigerator according to claim 1 wherein said second suction gas inlet means has an inlet funnel construction and said first gas inlet means has an outlet nozzle construction cooperable with and in spaced relation to said inlet funnel construction.

8. A refrigerator with an encapsulated motor compressor, comprising, a capsule, a compressor unit resiliently mounted in said capsule, a housing casting for said compressor unit, said housing casting defining a cylinder chamber for receiving a piston and a combined sound damping and centrifugal liquid separator chamber, first suction gas inlet means connected to and extending through said capsule to said combined chamber, second suction gas inlet means connected to said housing casting and having fluid communication with said combined chamber, said first and second suction gas inlet means having fluid communication and being relatively moveable to each other, said combined chamber having a rotationally symmetrical separator face with a vertical axis for operation as a liquid separator, a tangential inlet passage between said second suction gas inlet means and the top of said separator face, central gas outlet means adjacent the top of said separator face, a central liquid outlet aperture at the bottom of said separator face, said combined chamber forming the first chamber of a suction sound damper having at least two chambers, a second sound damping chamber being defined by a depression in said housing, and passage means extending between said second sound damping chamber and said combined chamber.

9. A refrigerator with an encapsulated motor compressor, comprising, a capsule, a compressor unit resiliently mounted in said capsule, a housing casting for said compressor unit, said housing casting defining a cylinder chamber for receiving a piston and a combined sound damping and centrifugal liquid separator chamber, first suction gas inlet means connected to and extending through said capsule to said combined chamber, second suction gas inlet means connected to said housing casting and having fluid communication with said combined chamber, said first and second suction gas inlet means having fluid communication and being relatively moveable to each other, said combined chamber having a rotationally symmetrical separator face with a vertical axis for operation as a liquid separator, a tangential inlet passage between said second suction gas inlet means and the top of said separator face, central gas outlet means adjacent the top of said separator face, a central liquid outlet aperture at the bottom of said separator face, said combined chamber forming the first chamber of a suction sound damper having at least two chambers a passage extending from the last of said chambers of said suction sound damper to said cylindrical chamber, said last referred to passage having a branch throttle passage having fluid communication with the interior atmosphere of said capsule.

* * * * *